US006021606A

United States Patent [19]

Kos

[11] Patent Number: 6,021,606

[45] Date of Patent: Feb. 8, 2000

[54] LIFTING MECHANISM FOR HORIZONTAL HINGED DOORS

[75] Inventor: Jacob J. Kos, Farmington, Conn.

[73] Assignee: The Bilco Company, West Haven, Conn.

[21] Appl. No.: 09/164,972

[22] Filed: Oct. 1, 1998

[51] Int. Cl.[7] ..... E05F 1/00

[52] U.S. Cl. ..... 49/386; 16/289; 16/357

[58] Field of Search ..... 49/386, 387; 16/1 C, 16/357, 289

[56] References Cited

U.S. PATENT DOCUMENTS

| | | | |
|---|---|---|---|
| 2,939,738 | 6/1960 | Lyons . | |
| 3,651,539 | 3/1972 | Breunich et al. | 16/357 X |
| 4,430,770 | 2/1984 | Niekrasz et al. | 49/386 X |
| 5,205,073 | 4/1993 | Lyons, Sr. . | |
| 5,704,569 | 1/1998 | Daniels | 49/386 X |

*Primary Examiner*—Jerry Redman

*Attorney, Agent, or Firm*—DeLio & Peterson LLC

[57] ABSTRACT

A horizontal door assembly is provided with pivotal counter balancing spring comprising an upper cylinder and a mating lower cylinder to force the cover of the door to an open position when the door assembly is unlocked wherein the upper cylinder of the counter balancing spring is configured to reduce the forces of the spring on the pivot points of the counter balancing mechanism thereby increasing the life of the counter balancing mechanism. In a preferred embodiment, the counter balancing spring mechanism is made of plastic and has an ear at the upper end thereof with an elongated slot opening the slot having a longitudinal axis substantially parallel to the longitudinal axis of the cylinder for mating with a pin inserted in an opening in a yoke bracket attached to the lower side of the cover. When the cover is in the closed position, the bottom of the cover rests on the upper surface of the ear and the pivot pin is positioned intermediate the elongated slot opening thus reducing the spring forces on both the pivot point of the counter balancing spring mechanism and on the spring mechanism.

6 Claims, 5 Drawing Sheets

LIFTING MECHANISM FOR HORIZONTAL HINGED DOORS

BACKGROUND OF THE INVENTION

1. Field of the Invention

The present invention relates to horizontal hinged doors which are pivotally spring cylinder loaded toward the open position and, in particular, to a spring cylinder lifting mechanism whereby a portion of the spring forces necessary to open the door are distributed from the spring lifting mechanism structure to the door thus reducing the forces on the mechanism especially at the upper pivot point and enabling the lifting mechanism to be made with engineering materials having a wide range of strengths such as plastics.

2. Description of Related Art

Hatch or door structures are usually mounted horizontally or at least at an angle to the vertical, as in the case of roof scuttles for buildings. The structures are commonly termed horizontal doors and are typically used in sidewalks, in the floors of industrial facilities for access to subterranean locations and for roof access in large buildings. Doors of this type are often made of metal, typically steel or aluminum and due to their weight, they are normally counterbalanced for safety and ease of operation.

In general, the doors are made utilizing a frame, typically a channel frame, surrounding the door with the frame being secured to the door opening. The metal cover (door) for the doorway is hinged to the frame so that it swings upwardly to the open vertical position or downwardly to the closed horizontal position. The heavy weight of the metal cover necessitates the need for a counter balancing mechanism to aid in the opening and/or closing of the door. Typically, the counter balancing mechanism comprises two concentric cylinders mounted between the frame and the door and containing a spring therein. The spring cylinders comprise two cylindrical halves sealed at the ends, which slide together about an internal spring. As the door is closed, the spring inside the spring cylinders is compressed thereby providing a counter balancing force. Similarly, when the door is open the spring provides a force swinging the door upward to the open position. The bottom half of the spring cylinder is typically rotably (pivotally) connected to the frame at its lower end. The concentric upper half of the spring cylinder is rotably (pivotally) connected at its upper end to a flange on the underside of the door. Accordingly, when the door is moved to an open or closed position, the spring cylinders pivot about their upper and lower pivot axis either compressing or decompressing the spring.

In some cover constructions, the force of the lifting springs is insufficient to prevent the door from accidentally swinging closed and a locking means is typically provided to prop the door in its open position. Quite often a door will have a fixed ladder mounted below the door. When a user is descending the ladder and desires to close the overhead door, he must be able to do so with one hand while holding onto the ladder with the other hand. Accordingly, the props are designed so that the prop can be disengaged with one hand while closing the door as shown in U.S. Pat. No. 5,205,073 to Robert Lyons, Sr. and assigned to the assignee of the present invention. U.S. Pat. No. 5,205,073 is incorporated herein by reference.

Due to the weight of the doors, the springs used to counter balance the doors are very strong and produce large forces in the spring housings in both the open door and closed door positions. The forces generated by the spring act on each halve of the spring housings with the forces being generally concentrated at the pivot points at the frame flange and at the door flange. Metal has been the preferred material of construction for the spring cylinders but plastics are now becoming more desirable due to their increased strength and other operating characteristics such as corrosion resistance. Unfortunately, the plastics and other like materials typically do not have the strength of metal especially fatigue strength and since the doors are generally designed for a 50 year life the door may be opened and closed thousands of times during this time. The forces acting on the spring cylinders especially plastic cylinders will eventually cause fracture of the cylinders with the cylinder then needing replacement. The use of plastic and other inherently weak materials for the spring cylinder housings is thus complicated by the extreme spring forces as well as the opening and closing forces and the use of plastic spring cylinder housings in horizontal and other door assemblies is severely restricted because of the demands on the material.

Bearing in mind the problems and deficiencies of the prior art, it is an object of the present invention to provide a door assembly and in particular a horizontal hinged door assembly with counter balancing spring means wherein cylinders containing spring means used to open and close the doors are made of plastic or other non-metallic or metallic materials.

It is a further object of the present invention to provide spring cylinder housings for door assemblies including horizontal hinged door assemblies which housings are made of plastic or other non-metallic or metallic materials.

Other objects and advantages of the present invention will be readily apparent from the following description.

SUMMARY OF THE INVENTION

The above and other objects and advantages, which will be apparent to one skilled in the art are achieved in the present invention which is directed to, in a first aspect, a door assembly with counter balancing spring means to force the door to an open position when the door is unlocked comprising:

- a door having an upper surface and a lower surface and hingedly mounted to a frame at a hinge point for motion between an open and closed position;
- a latch and a mating catch to enable the door to be maintained in a closed position;
- a counter balancing mechanism comprising an upper cylindrical member and a lower cylindrical member, the lower cylindrical member preferably smaller in diameter than the upper cylindrical member, which members are sealed at the ends and which slide together about an internal spring, the upper member having at its upper end an ear with a slot opening therein in an axis preferably substantially along the longitudinal axis of the cylindrical members and being pivotally supported to the door at the slot and the lower member being pivotally supported to the frame at its lower end;
- a bracket attached to the lower surface of the door and having an opening therein;
- a pivot pin extending through the slot in the ear in the upper cylindrical member and the opening in the bracket to effect the pivotal movement of the upper cylindrical member of the counter balancing mechanism during opening and closing of the door;

wherein when the door is in the closed position, the top surface of the ear is in contact with the lower surface of the door and the pin extending through the slot is in a position intermediate the length of the slot.

In a further aspect of the invention, a counter balancing mechanism is provided for use in door assemblies to force the door to an open position when the door is unlocked comprising:

an upper cylindrical member which is sealed at the upper end and which has at the upper end an ear with a slot therein for pivotal attachment to the door typically to a bracket attached to the lower surface of the door the longitudinal axis of the slot being preferably in an axis substantially parallel to the longitudinal axis of the upper member;

a lower cylindrical member preferably smaller in diameter than the upper cylindrical member and which lower cylindrical member slides within the upper cylindrical member, the lower cylindrical member being sealed at the lower end thereof and having an opening at the lower end for pivotal attachment to a frame of the door;

spring means contained within the upper cylindrical member and lower cylindrical member;

wherein the ear of the upper cylindrical is configured so that when the counter balancing mechanism is used in the door assembly the top surface of the ear contacts the lower surface of the door when the door is in the closed position and a pivot pin connecting the door and the upper cylindrical member through the slot in the ear is intermediate the length of the slot.

In another aspect of the invention, a bracket attached to the door to provide a pivot point for the upper spring cylinder has a slot therein for movement of the pivot pin therein and the upper cylindrical member has an opening for the pin, the ear of the upper cylindrical member contacting the lower surface of the door when the door is in the closed position and the pivot pin being intermediate the length of the slot.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENTS

Figure 1:
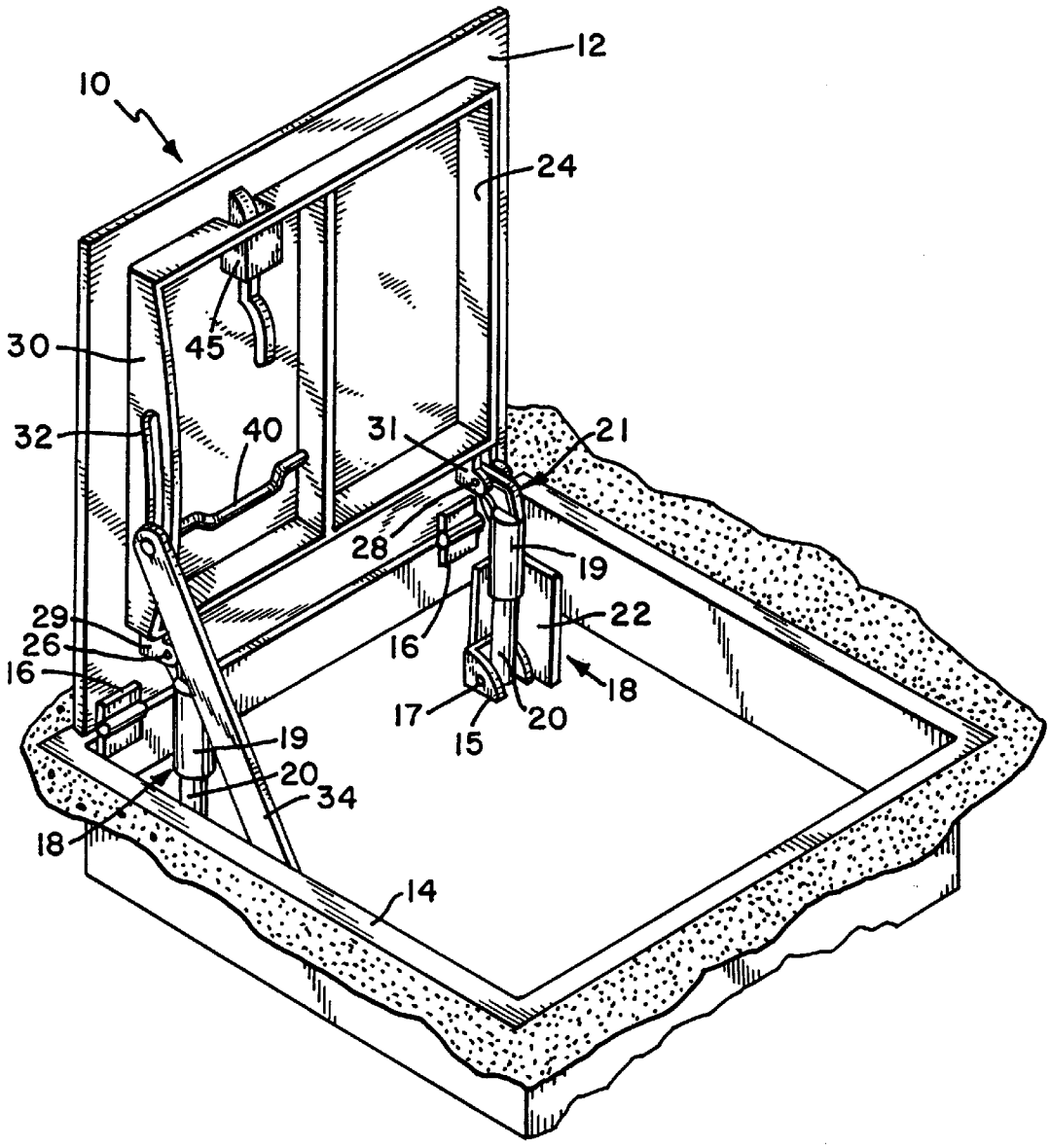
FIG. 1 is a perspective view of a counter balanced door with a counter balancing spring mechanism having an upper cylinder and a lower cylinder according to the present invention and showing the door in an open position.

In describing the preferred embodiments of the present invention, reference will be made herein to FIGS. 1–8 of the drawings in which like numerals refer to like features of the invention. Features of the invention are not necessarily shown to scale in the drawings.

Referring to FIG. 1, a counter balanced horizontal door assembly according to the present invention is generally indicated as 10. The assembly includes a cover 12 hinged to a frame 14 with hinges 16. The frame 14 is typically a channel frame but is shown here as a solid member for convenience.

A counter balanced mechanism comprising a spring cylinder shown generally as 18 is pivotally mounted between the frame 14 and the cover 12. Spring cylinders are well known in the art and comprise two cylindrical halves shown as upper cylinder 19 and lower cylinder 20 and which are preferably sealed at the ends and would slide together about an internal spring (not shown). As the cover 12 is closed, the spring inside spring cylinder 18 is compressed thereby providing the counter balance support. When the door is opened the spring in spring cylinder 18 is decompressed and would lift the cover 12.

The lower end of lower cylinder 20 of spring cylinder 18 is pivotally connected to a yoke bracket 15 by pivot pin 17 with the bracket 15 being attached to structural member 22 which member 22 is attached to the frame 14. The upper cylinder 19 of the spring cylinder 18 is pivotally connected to the cover 12 by yokes 31 and 29 connected to the door below the door stiffener 24 and control slot member 30, respectively. The upper cylinder 19 of the left spring cylinder 18 in FIG. 1 is pivotally connected to yoke 29 via a pivot pin 26 which enables rotation of the spring cylinder 18 as the door is closed or opened. The upper cylinder 19 of the right spring cylinder 18 is mounted in a similar manner via pivot pin 28 to yoke 31. Details of the pivot pin and yoke brackets are shown hereinbelow.

Control slot member 30 acts like door stiffener 24 except that it also includes a curved controlled slot 32 for opening and closing the door. A control arm 34 is pivotally mounted to the frame 14 at a front end near the bottom of the arm 34. The second end of the top of the arm 34 swings in slot 32. A handle 40 is provided to assist in opening and closing the door. A latch mechanism 45 is shown connected to the door and will mate with a locking mechanism at the opposed end of frame 14 (not shown) when the cover 12 is closed.

In general, to provide a hold open force, the door is designed such that the internal spring of spring cylinders 18 are slightly compressed when the door is fully open. This is accomplished by selecting appropriate lengths of the spring inside the spring cylinder 18.

The cover 12 may be of any desired size. Extra structural members and stiffeners are added as necessary for the intended application, which may include foot traffic or vehicle traffic on the upper surface of the door. The door and frame are commonly manufactured of steel or heavy gauge aluminum and sufficient extra counter balancing spring cylinders are added in parallel between the door and the frame to counter balance the weight of the door. To close the door from below, handle 40 is pulled and control arm 34 moves in slot 32 until the door reaches a fully closed position as shown in FIG. 4E.

Figure 2B:
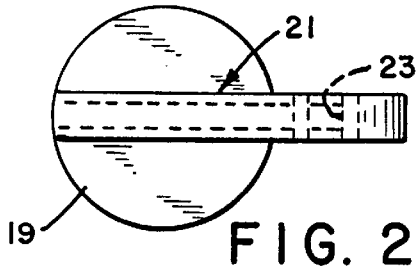
FIGS. 2A and 2B show an elevational view of the upper cylinder housing and a plan view of the upper cylinder housing, respectively.
Figure 2A:
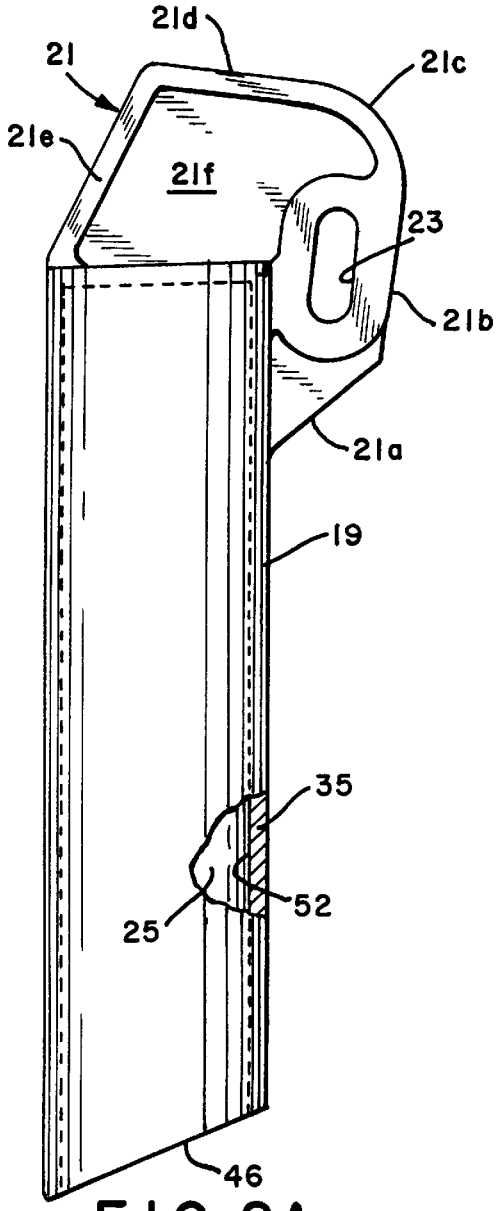

Referring now to FIGS. 2A and 2B, the upper spring cylinder 19 of the spring cylinder counter balancing mechanism is shown. The upper spring cylinder 19 is generally cylindrical having an opening 25 running the length of the cylinder to the sealed upper end. The cylinder 19 is shown having a wall thickness 35, an inner wall 52 and an angled lower end 46 which enables a longer cylinder 19 to be used in the door assembly for structural purposes as discussed below.

Figure 8:
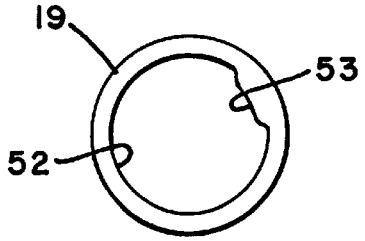
FIG. 8 is a top plan view of an upper cylinder counter balancing spring mechanism of the invention in which a section of the upper cylinder housing wall thickness is thicker to provide a closer fit between the upper cylinder and lower cylinder during opening and closing of the door.

The diameter of upper cylinder 19 is generally about 2 inch and its length about 8 inch. The wall thickness is sufficient to provide structural integrity and is typically about 1/16 to 1/8 inch. As shown in FIG. 8, the inner wall 52 of the upper cylinder 19 is preferably thicker along a portion of the wall 53. This allows a closer fit between the upper cylinder and lower cylinder at both open and closed door positions as shown in FIGS. 4A–4E where the upper cylinder 19 and lower cylinder 20 are not aligned in the door open portion. This design lowers the stress forces in the spring cylinders.

At the upper end of cylinder 19 is an ear typically narrower than the diameter of the cylinder 19 configured for pivotal engagement with the roof bracket and generally designated as 21. The ear has a side 21*a* shown angularly connected to the outer wall of cylinder 19 and connected sides 21*b*, 21*c*, 21*d* and 21*e* forming the ear which runs from one outer side of the cylinder to the opposed other outer side of the cylinder. The ear 21*a*–21*e* is typically flanged at its outer edge and around slot 23 for strength and forms a recessed area 21*f*. A vertical slot 23 is shown in ear 21 and its longitudinal axis is substantially in the same axis as the longitudinal axis of the cylinder 19. Wall 21*d* is angled downwardly but will be substantially level against the bottom of the door when the door is closed as shown hereinbelow. Sidewall 21*c* is curved to minimize stress forces on ear 21 and cylinder 19 when the door is closed and the bottom of the door contacts the ear.

FIG. 2B is a plan view of the cylinder of FIG. 2A and shows the cylinder 19 having ear 21 and slot opening 23. The width of the ear 21 is narrower than the diameter of the cylinder 19. This width may be of any convenient size to satisfy the structural requirement of the cylinder. Typically, the ratio of the width of the ear 21 to the diameter of the cylinder is about 1:4. The width of slot 23 is sufficient for a pivot pin to pass through.

Figure 3A:
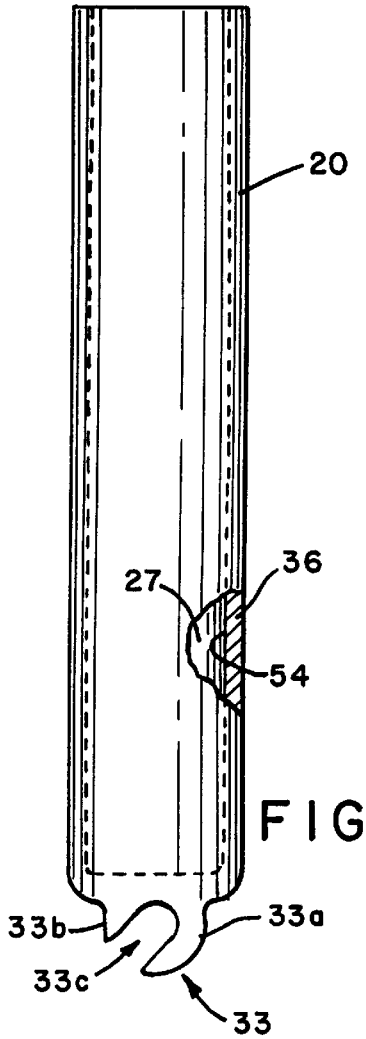
FIGS. 3A and 3B show an elevational view of the lower cylinder housing and a bottom view of the lower cylinder housing, respectively.

Referring now to FIG. 3A, a lower spring cylinder housing 20 is shown having a wall thickness 36, an inner wall 54 and an open area 27 running the length of the cylinder to the base of the cylinder. At the lower end of housing 20 is an integral pivot member shown generally as 33. The pivot member 33 has downwardly extending legs 33*a* and 33*b* forming an open pivot point 33*c*. A pin attached to the frame or a bracket attached to the frame would be mated to the cylinder 20 at pivot point 33*c* to allow pivotal movement of cylinder 20 about the frame. A bounded pivot pin opening could also be used but the open pivot point allows the lower cylinder to be easily snapped onto and off the pivot pin.

Figure 3B:
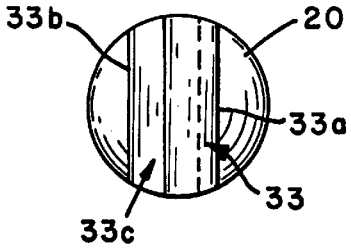

FIG. 3B shows a bottom plan view of cylinder 20. It will be noted that the inside diameter of upper cylinder 19 of FIG. 2A is larger than the outer diameter of the lower cylinder 20 of FIG. 3A. This enables lower spring cylinder 20 to be inserted into upper spring cylinder 19 and the two cylinders move relative to each other by action of a spring placed within the cylinders.

Figure 4A:
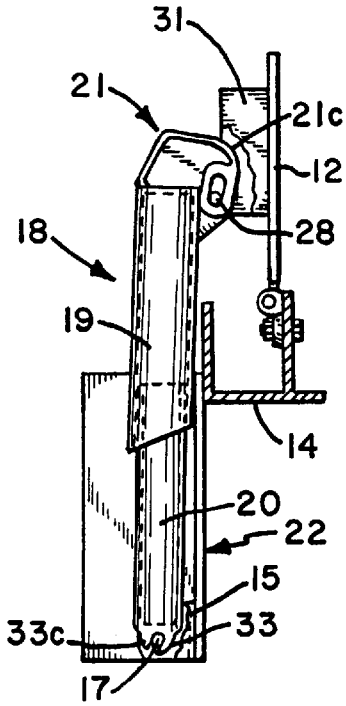
FIGS. 4A–4E show, in sequence, movement of the counter balancing mechanism of the present invention when the door is moved from the open door position of FIG. 4A to the closed door position in FIG. 4E.
Figure 4B:
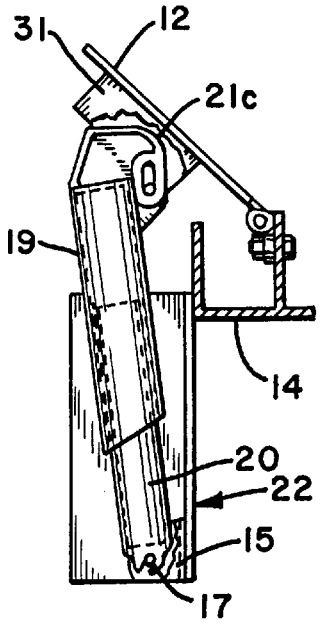
Figure 4C:
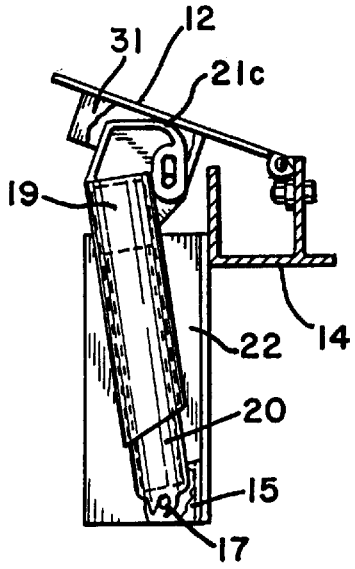
Figure 4D:
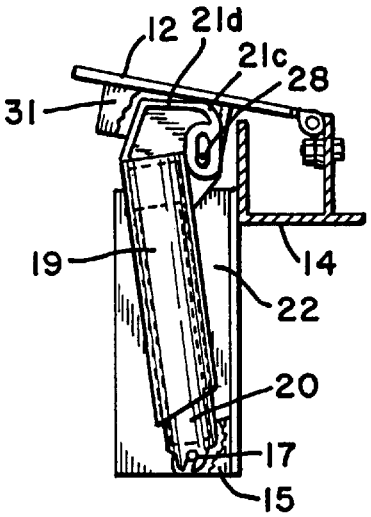
Figure 4E:
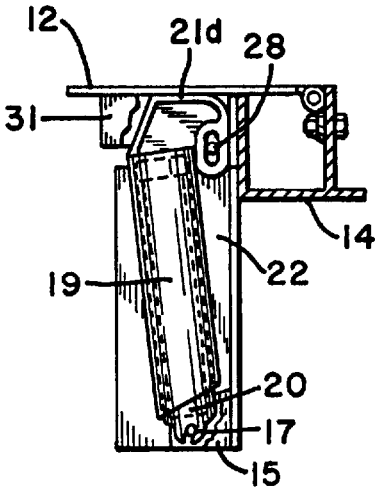

Referring to FIGS. 4A–4E, use of the counter balancing mechanism of the invention with a horizontal door may be demonstrated. In FIG. 4A, a spring cylinder 18 having a lower cylinder 20 and upper cylinder 19 is shown pivotally connected to cover 12 and frame bracket 15. Bracket 15 is attached at structural member 22 and frame 14. Spring cylinder 20 is typically connected at the lower end of member 22 by pivot pin 17 by attaching the cylinder 20 and the pivot pin 17 in a groove 33*c* of pivot member 33 of cylinder 20. At the upper end of spring cylinder 18, pin 28 pivotally connects ear 21 of upper spring cylinder 19 and yoke 31. Yoke 31 is attached to cover 12.

The applied loads on the spring cylinder 19 and 20 may be as high as 1000 lb. or greater typically 600 lb. for a larger cylinder and 250 lb. for a smaller cylinder and also be subjected to moment forces. It is estimated that the spring cylinder must withstand 10,000 open and closing cycles with a life expectancy of 50 years. The maximum operating temperature for the door assembly is typically about 250° F. Any suitable engineering plastic may be used and a preferred plastic is a reinforced nylon 6/6 resin sold as Verton® RF-700-10 by LNP Engineering Plastics, Inc., Exton, Pa.

Referring to FIG. 4B, as the cover 12 is closed, cover 12 moves downward and upper cylinder 19 is compressed into lower cylinder 20. In FIG. 4C, the wall portion 21*c* of ear 21 is shown contacting the lower surface of cover 12 as the cover 12 is moved downward. The curve of wall portion 21*c* produces a downward force rather than a lateral force. In FIG. 4D, the cover is shown almost closed with the lower part of cover 12 now contacting the upper portion 21*d* of ear 21. In a fully closed position as shown in FIG. 4E, the lower part of cover 12 is contacting wall portion 21*d* of ear 21. Pivot pin 28 is shown intermediate slot 23 thereby relieving the pressure on upper spring cylinder 19 at the pivot point and in the spring cylinder. It can be seen from FIG. 4E, the cover 12 rests not on pin 28 or slot 23 but on the upper surface 21*d* of ear 21 which is in pressure contact with the lower surface of cover 12. This is the crux of the invention and enables the use of engineering plastics for door assembles.

In another important feature of the invention, the ear 21 is configured so that the bottom of cover 12 first contacts curved ear wall 21*c* during closing instead of top ear wall 21*d*. This reduces the forces on ear 21 during closing of the door.

Figure 5:
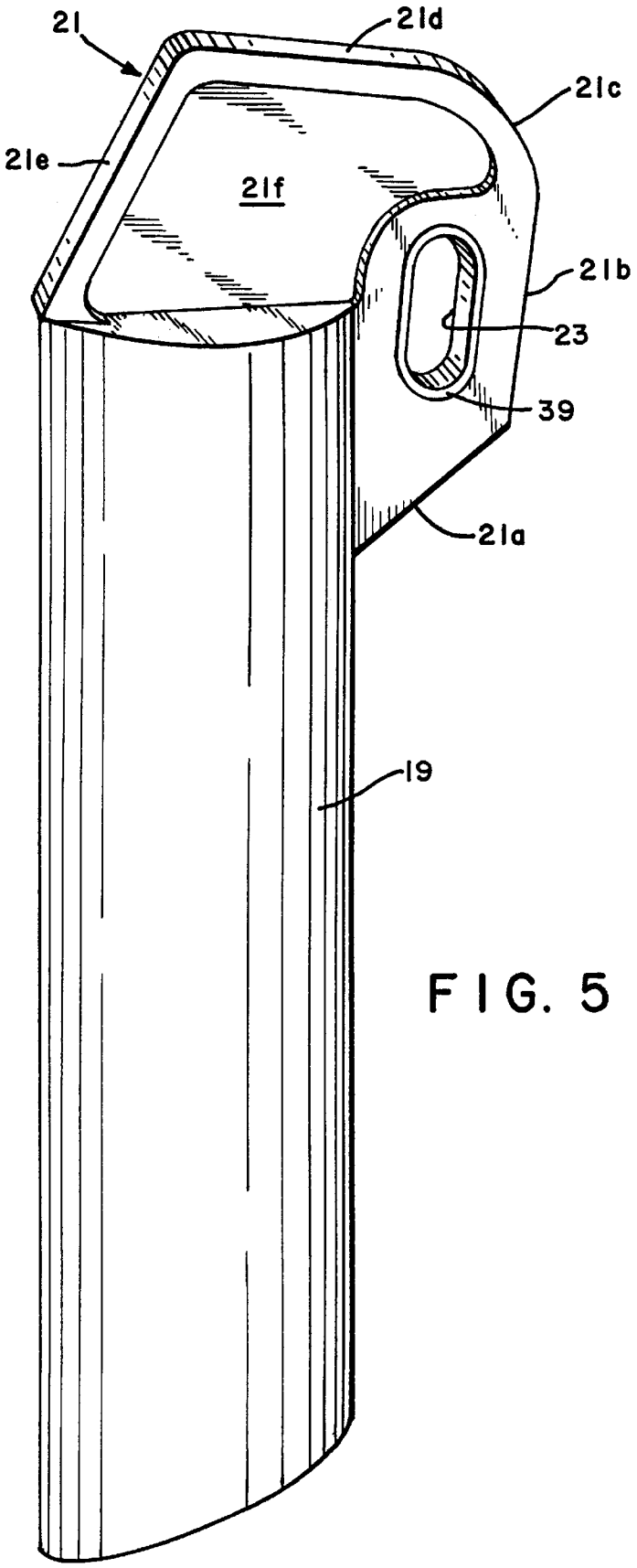
FIG. 5 shows a perspective view of an upper cylinder spring housing according to the invention.

Referring to FIG. 5, a perspective view of a preferred upper spring cylinder 19 of the invention is shown. Slot 23 is shown preferably having a metal insert 39 to provide increased wear resistance to the spring cylinder. Wall members 21*a*–21*e* are shown forming ear 21 and recessed area 21*f*.

Figure 6A:
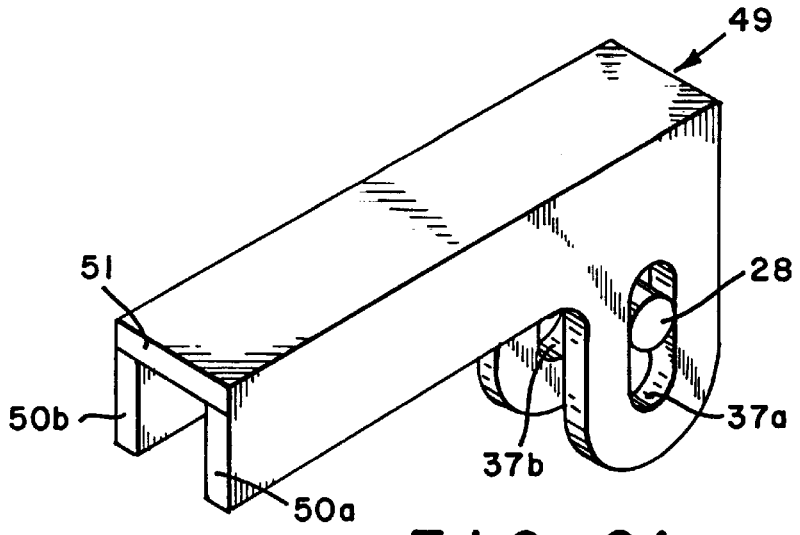
FIG. 6A is a perspective view of a slotted door bracket for connection to the lower surface of a door for use with a counter balancing mechanism of the invention.
Figure 6B:
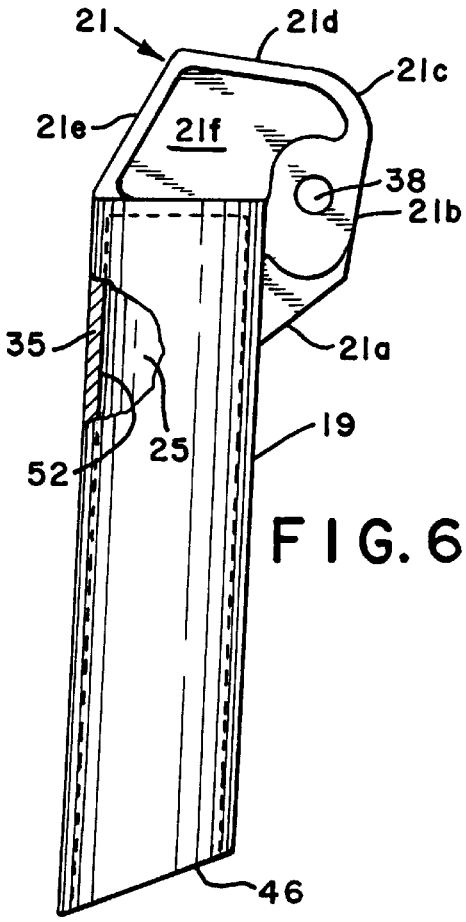
FIG. 6B is an elevational view of an upper cylinder spring housing for use with the slotted door bracket shown in FIG. 6A

Another aspect of the invention is shown in FIGS. 6A–6B. In this embodiment, the yoke 49 which is attached to the bottom of the door is shown having slots 37*a* and 37*b* therein instead of a circular opening for a pin as shown above. A pivot pin 28 is shown intermediate the length of slots 37*a* and 37*b* which would be the position of the pin when the cover is closed. The yoke 49 comprises two separated parallel members 50*a* and 50*b* joined by a flat plate 51 forming an open area between members 50*a* and 50*b* where the ear of the upper cylinder will be pivotally positioned. The flat plate is typically welded to the underside of cover 12. In FIG. 6B, an upper cylinder 19 of the invention for use with the bracket of FIG. 6A is shown having an ear 21 and a pivot pin opening 38. This counter balancing spring mechanism would be connected in the same way as shown hereinabove except that ear 21 of upper spring cylinder 19 does not contain a slot. The slot is in yoke 49 which is attached to the door. In operation, the upper surface 21*d* of upper cylinder 19 would still contact the underside of cover 12 in the closed position and relieve the forces on pivot pin opening 38 in upper cylinder 19.

Figure 7:
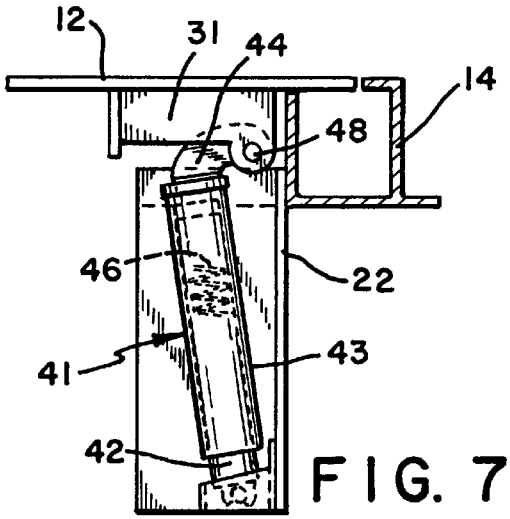
FIG. 7 is an elevational cross-sectional view of a prior art counter balancing mechanism employed in a horizontal door and showing the door in a closed position.

Referring to FIG. 7, a spring cylinder of the prior art is shown generally as 41. The spring cylinder 41 comprises a lower cylinder 42 and an upper cylinder 43. The upper cylinder 43 has an ear 44 attached thereto which is pivotally mounted by pin 48 to yoke 31. FIG. 7 shows the cover in a closed position and accordingly, the ear 44 of upper cylinder 43 is subjected to tremendous force particularly at pivot point 48 from internal spring 46. In comparison, it will be appreciated by those skilled in the art, that the use of a cylinder having an ear of the invention shown in FIGS. 4A–4E and 5 relieves the pressure on the pivot point upper cylinder when the cover is in a closed position because the upper portion of the ear contacts the lower surface of the door and relieves the pressure on the pivot point.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A horizontal door assembly with counter balancing spring means comprising:

a door having an upper surface and a lower surface and hingedly mounted to a frame at a hinge point for motion between an open and closed position;

a latch and a mating catch to enable the door to be maintained in a closed position;

a counter balancing mechanism comprising an upper cylindrical member and a lower cylindrical member which members are sealed at the ends and which slide together about an internal spring, the upper member having at its upper end an ear with an upper surface and with a slot opening therein in an axis substantially along the longitudinal axis of the cylindrical members and being pivotally supported to the door at the slot and the lower member being pivotally supported to the frame at its lower end;

a bracket attached to the lower surface of the door and having an opening therein;

a pivot pin extending through the slot in the ear in the upper cylindrical member and the opening in the bracket to effect the pivotal movement of the upper cylindrical member of the counter balancing mechanism during opening and closing of the door;

wherein when the door is in the closed position, the upper surface of the ear is in contact with the lower surface of the door and the pin extending through the slot is in a position intermediate the length of the slot.

2. The door assembly of claim 1 wherein the upper cylindrical member and lower cylindrical member are made of plastic.

3. A counter balancing mechanism for use in horizontal door assemblies comprising a door having a lower surface with a bracket attached thereto and an upper surface and a frame for the door, the counter balancing mechanism comprising:

an upper cylindrical member which is sealed at the upper end and which has at the upper end an ear with an upper surface and with a slot therein for pivotal attachment to the bracket attached to the lower surface of the door, the longitudinal axis of the slot being in an axis substantially parallel to the longitudinal axis of the upper member;

a lower cylindrical member smaller in diameter than the upper cylindrical member and which lower cylindrical member slides within the upper cylindrical member, the lower cylindrical member being sealed at the lower end thereof and having an opening at the lower end for pivotal attachment to the frame of the door;

spring means contained within the upper cylindrical member and lower cylindrical member;

wherein the ear of the upper cylindrical member is configured so that the upper surface of the ear contacts the lower surface of the door when the door is in the closed position and a pivot pin connecting the bracket of the door and the upper cylindrical member through the slot in the ear is intermediate the length of the slot.

4. The counter balancing member of claim 3 wherein the upper cylindrical member and lower cylindrical member are made of plastic.

5. A horizontal door assembly with counter balancing spring means comprising:

a door having an upper surface and a lower surface and hingedly mounted to a frame at a hinge point for motion between an open and closed position;

a latch and a mating catch to enable the door to be maintained in a closed position;

a counter balancing mechanism comprising an upper cylindrical member and a lower cylindrical member which members are sealed at the ends and which slide together about an internal spring, the upper member having at its upper end an ear with an upper surface and with an opening therein and being pivotally supported to the door at the opening and the lower member being pivotally supported to the frame at its lower end;

a bracket attached to the lower surface of the door and having a slot therein which is in substantially the same longitudinal axis as the upper cylindrical member when the door is in the closed position;

a pivot pin extending through the slot in the bracket and the opening in the upper cylindrical member to effect the pivotal movement of the upper cylindrical member of the counter balancing mechanism during opening and closing of the door;

wherein when the door is in the closed position, the upper surface of the ear is in contact with the lower surface of the door and the pin extending through the slot is in a position intermediate the length of the slot.

6. The door assembly of claim 5 wherein the upper cylindrical member and lower cylindrical member are made of plastic.

* * * * *